US006168391B1

(12) United States Patent
Ono

(10) Patent No.: US 6,168,391 B1
(45) Date of Patent: Jan. 2, 2001

(54) OIL PUMP APPARATUS

(75) Inventor: Hisashi Ono, Toyota (JP)

(73) Assignee: Aisin Seiki Kabushiki Kaisha, Aichi-pref. (JP)

( * ) Notice: Under 35 U.S.C. 154(b), the term of this patent shall be extended for 0 days.

(21) Appl. No.: 09/280,007

(22) Filed: Mar. 29, 1999

(30) Foreign Application Priority Data

Mar. 27, 1998 (JP) ..... 10-081641

(51) Int. Cl.[7] ..... F04B 49/00; F01C 1/10

(52) U.S. Cl. ..... 417/310; 418/171
(58) Field of Search ..... 417/310; 418/171

(56) References Cited

U.S. PATENT DOCUMENTS

| | | | | |
|---|---|---|---|---|
| 5,738,501 | * | 4/1998 | Eisenmann | 417/310 |
| 5,759,013 | * | 6/1998 | Miyazaki et al. | 417/310 |
| 5,842,449 | | 12/1998 | Eisenmann | 123/90.12 |

FOREIGN PATENT DOCUMENTS

| | | |
|---|---|---|
| 195 23 533 A1 | 6/1995 | (DE) . |
| 19523533 A1 | 6/1995 | (DE) . |
| 0712 997 A2 | 5/1996 | (EP) . |
| 0785361 A1 | 7/1997 | (EP) . |
| 9-256969 | 9/1997 | (JP) . |

OTHER PUBLICATIONS

Letter from German patent law firm Herman–Trentepohl, Grosse, Bockhorni & Partner regarding above–referenced DE 19523533 A1.

* cited by examiner

*Primary Examiner*—Timothy S. Thorpe
*Assistant Examiner*—Michael K. Gray
(74) *Attorney, Agent, or Firm*—Reed Smith Hazel & Thomas LLP

(57) ABSTRACT

This invention relates to an oil pump apparatus which comprises an oil pump housing, a rotor rotatably located in the oil pump housing, the rotor forming a first set of pockets having a capacity increasing toward a rotating direction of the rotor and a second set of pockets having a capacity decreasing toward the rotating direction of the rotor, a plurality of suction ports connected with the first set of pockets, each of the suction ports being isolated from other adjacent suction ports, a discharge port connected with the second set of the pockets, and a control valve which includes a valve member, an urging member for urging the valve member and an urging member's chamber for disposing the urging member, the control valve being operatively positioned to control fluid flow through the plurality of the suction ports and the discharge port, and the control valve is operatively connected to select between a first condition in which the control valve connects with the suction ports and a second condition in which the control valve connects the discharge port with one of the suction ports and cuts off the other suction ports wherein the urging member's chamber is always communicated with one of the suction ports.

6 Claims, 3 Drawing Sheets

OIL PUMP APPARATUS

FIELD OF THE INVENTION

The present invention relates to an oil pump apparatus for a vehicle, and more particularly, an oil pump apparatus which has a higher pressure when the revolution of a drive source, for example a crankshaft of an internal combustion engine, increases.

BACKGROUND OF THE INVENTION

In Unexamined Published Japanese Patent Application (Kokai) No. Hei 9-256969, for example, there is disclosed a conventional oil pump apparatus. The conventional oil pump apparatus comprises: an oil pump housing, a rotor rotatably located in the oil pump housing, the rotor forming a first set of pockets having a capacity or volume increasing toward a rotating direction of the rotor and a second set of pockets having a capacity or volume decreasing toward the rotating direction of the rotor, a plurality of suction ports connected with the first set of pockets, each of the suction ports being isolated from other adjacent suction ports, a discharge port connected with the second set of the pockets, and a control valve which includes a valve member, a spring for urging the valve member and a spring chamber for disposing the spring, the control valve being operatively positioned to control fluid flow through the plurality of the suction ports and the discharge port, and the control valve is operatively connected to select between a first condition in which the control valve connects with the suction ports and a second condition in which the control valve connects the discharge port with one of the suction ports and cuts off the other suction ports.

In the above conventional oil pump apparatus, when the revolving speed of the rotor is increased to obtain more discharged hydraulic pressure of the hydraulic oil than necessary, the surplus discharged hydraulic pressure is supplied to one of the suction ports by the control valve. As a result, the oil pump apparatus becomes more efficient.

Here, in the above conventional oil pump apparatus, since the volume of the spring chamber is varied with respect to the movement of the valve member, the spring chamber opens to the atmosphere such that the variation of the pressure of the spring chamber does not prevent the valve member from sliding. However, the opening of the spring chamber draws the air in the oil pump apparatus, when the oil pump apparatus is rotated. Thus, there is some concern that the air drawing makes the oil pump apparatus become inefficient and noisy.

SUMMARY OF THE INVENTION

The present invention provides an oil pump apparatus without the foregoing drawbacks.

In accordance with the present invention, an oil pump apparatus comprises an oil pump housing; a rotor rotatably located in the oil pump housing, the rotor forming a first set of pockets having a capacity increasing toward a rotating direction of the rotor and a second set of pockets having a capacity decreasing toward the rotating direction of the rotor; a plurality of suction ports connected with the first set of pockets, each of the suction ports being isolated from other adjacent suction ports; a discharge port connected with the second set of the pockets; and a control valve which includes a valve member, an urging member for urging the valve member and an urging member's chamber for disposing the urging member, the control valve being operatively positioned to control fluid flow through the plurality of the suction ports and the discharge port, and the control valve is operatively connected to select between a first condition in which the control valve connects with the suction ports and a second condition in which the control valve connects the discharge port with one of the suction ports and cuts off the other suction ports, wherein the urging member's chamber is always communicated with one of the suction ports.

Other advantages of invention will become apparent during the following discussion of the accompanying drawings.

BRIEF DESCRIPTION OF THE DRAWING FIGURES

The foregoing and additional features of the present invention will become more apparent from the following detailed description of a preferred embodiment thereof when considered with reference to the attached drawings, in which.

DETAILED DESCRIPTION OF THE PREFERRED EMBODIMENTS

An oil pump apparatus in accordance with a preferred embodiment of the present invention will be described with reference to the attached drawings.

Figure 1:
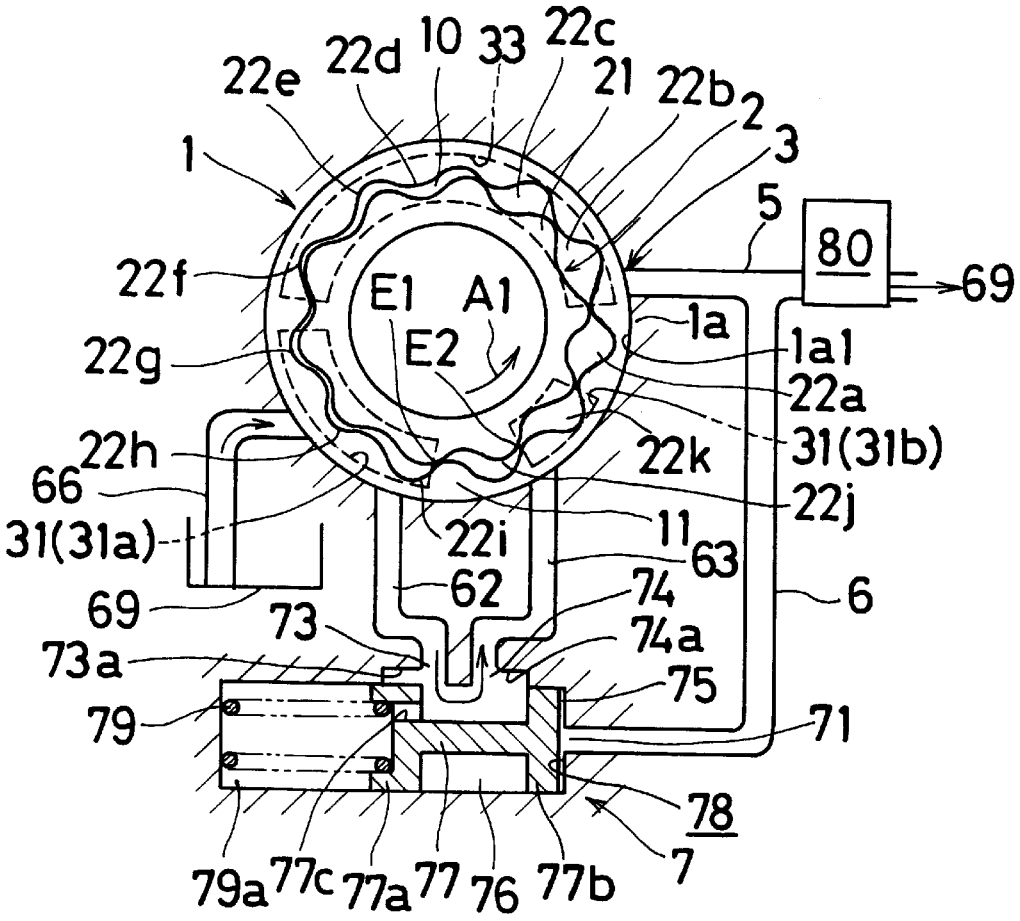
FIG. 1 is a diagrammatic illustration view of an oil pump apparatus in accordance with the present invention, when the revolving speed of the rotor is at low speed.

FIG. 1 is a diagrammatic illustration view of an oil pump apparatus. The oil pump apparatus is adapted for mounting on a vehicle and is actuated by a crankshaft of an internal combustion engine. An oil pump 1 of the oil pump apparatus is provided with an oil pump housing 1*a* which is made of metal, such as an aluminum-based alloy or an iron-based alloy. In the oil pump housing 1*a*, a pump chamber 1*a*1 is formed. In the pump chamber 1*a*1, an outer rotor 3 is rotatably disposed. The outer rotor 3 is provided with a plurality of internal gear teeth 11 so as to constitute a driven gear. Further, in the pump chamber 1*a*1, an inner rotor 2 is rotatably disposed therein and is located inside the outer rotor 3. An axis of the outer rotor 3 and an axis of the inner rotor 2 are placed within a predetermined distance. The inner rotor 2 is connected to the crankshaft of the internal combustion engine, and is rotated together with the crankshaft. In general, the inner rotor 2 is designed to rotate at a revolving speed of 600 to 7,000 rpm.

On an outer periphery of the inner rotor 2, a plurality of external gear teeth 21 is provided so as to constitute a drive gear. The internal gear teeth 11 and the external gear teeth 21 are designed to be a trochoid curve or a cycloid curve. The inner rotor 2 is rotated in the direction of the arrow A1 of FIG. 1. As the inner rotor 2 is rotated, the external gear teeth 21 of the inner rotor 2 engage with the internal gear teeth 11 of the outer rotor 3 one after another. Accordingly, the outer rotor 3 is rotated in the same direction. Between the internal gear teeth 11 and the external gear teeth 21, there is formed pump room which has eleven pockets 22*a* through 22*k* as shown in FIG. 1. In FIG. 1, the pocket 22*a* has the largest volume of the pockets 22*a* through 22*k*, and the pocket 22*f* has the smallest volume of the same.

The pockets 22*g* through 22*k*, which are disposed in the upstream with respect to the pocket 22*a*, produce an inlet pressure, because their volumes enlarge as the inner rotor 2 is rotated, and they act to suck the hydraulic oil. The pockets 22*b* through 22*f*, which are disposed in the downstream with respect to the pocket 22*a*, produce an outlet pressure, because their volumes diminish as the inner rotor 2 is rotated, and they act to discharge the hydraulic oil.

In the oil pump housing 1*a* of the oil pump 1, a discharge port 33 is formed. The discharge port 33 is connected to the pockets 22*b* through 22*f*, and is adapted to discharge the hydraulic oil out of the pump chamber 1*a*1 as the inner rotor 2 is rotated. In the oil pump housing 1*a*, on the other hand, suction ports 31 are formed. The suction ports 31 consist of two suction ports 31*a* and 31*b*. The suction port 31*a* is connected to the pockets 22*g* through 22*i* and the suction port 31*b* is connected to the pocket 22*k*.

In the preferred embodiment, the suction port 31*b* is disposed downstream with respect to the suction port 31*a* in the rotary direction of the inner rotor 2 designated at the arrow A1. The opening area of the suction port 31*a* is larger than the opening area of the suction port 31*b*. As can be appreciated from FIG. 1, contact points E1 and E2 between the internal gear teeth 11 and the external gear teeth 21 are positioned between the suction port 31*a* and the suction port 31*b*. Accordingly, the suction port 31*a* and the suction port 31*b* do not communicate with each other along the peripheral direction of the pump chamber 1*a*1 Thus, the suction port 31*a* and the suction port 31*b* are adapted to suck the hydraulic oil independently of each other. One end of a suction hydraulic passage 66 is connected to the suction port 31*a* and the other end of the suction hydraulic passage 66 is connected to an oil store member, such as an oil pan 69, a reservoir, or an oil tank. The hydraulic oil is returned to the oil pan 69 from a hydraulic oil receiving unit 80.

A hydraulic-oil-delivery passage 5 is a passage which is adapted for delivering a hydraulic pressure of the hydraulic oil to the hydraulic oil receiving unit 80. The hydraulic-oil-delivery passage 5 has a branch passage 6. The branch passage 6 is connected to a first valve port 71 of a control valve 7.

Figure 4:
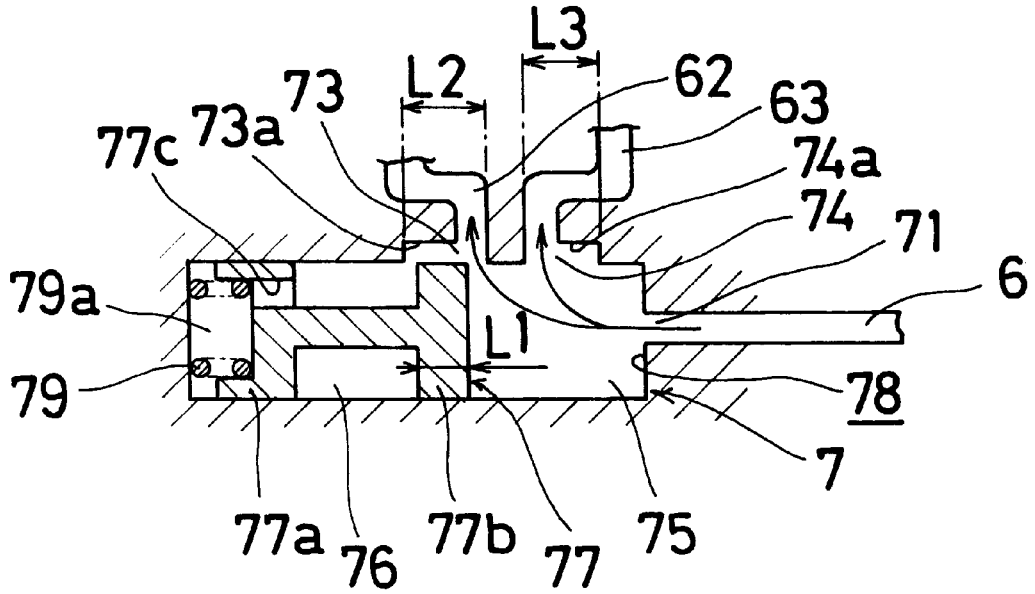
FIG. 4 is a sectional view of a control valve in accordance with the present invention, when the revolving speed of the rotor is at high speed.

The control valve 7 is located in the oil pump housing 1*a*. The control valve 7 is provided with a valve chamber 78, the first valve port 71, a second valve port 74, a third valve port 73, a valve member 77 and a spring or urging member 79. The first valve port 71 is communicated with the hydraulic-oil-delivery passage 5 via the branch passage 6. The second valve port 74 is communicated with the suction port 31*b* via a first intermediate hydraulic passage 63. The third valve port 73 is communicated with the suction port 31*a* via a second intermediate hydraulic passage 62. Both the first intermediate hydraulic passage 63 and the second intermediate passage 62 are formed in the oil pump housing 1*a*. In addition, the valve chamber 78 which is formed in the oil pump housing 1*a*. The valve chamber 78 is provided with a side passage 74*a* and a side passage 73*a*. The side passage 74*a* is disposed at the second valve port 74, the side passage 73*a* is disposed at the third valve port 73. Note that the valve member 77 is slidably fitted into the valve chamber 78, and is urged by the spring 79 in the rightward direction of FIG. 1. The valve member 77 includes a first land portion 77*b* and a second land portion 77*a*. The valve chamber 78 is divided into three rooms which are a head room 75, an intermediate room 76 and a spring room 79*a* by the land portions 77*a* and 77*b* as shown in FIG. 1. The first valve port 71 is communicated with the head room 75. The second valve port 74 with side passage 74*a* is controlled to communicate with the head room 75 and the intermediate room 76 by the first land portion 77*b* of the valve member 77, according to the pressure in the head room 75. The third port 73 with the side passage 73*a* is controlled to communicate with the head room 75 and the intermediate room 76 by the first land portion 77*b* of the valve member 77, according to the pressure in the head room 75. Here, as shown in FIG. 4, the axial length L1 of the first land portion 77*b* in the direction of the valve chamber 78 is smaller than the axial length L2 of the side passage 73*a*, is also smaller than the axial length L3 of the side passage 74*a*. The second land portion 77*a* of the valve member 77 has a passage 77*c* which connects the intermediate room 76 and the spring room 79 to each other. Therefore, the spring room 79 is always connected with the third port 73.

Figure 3:
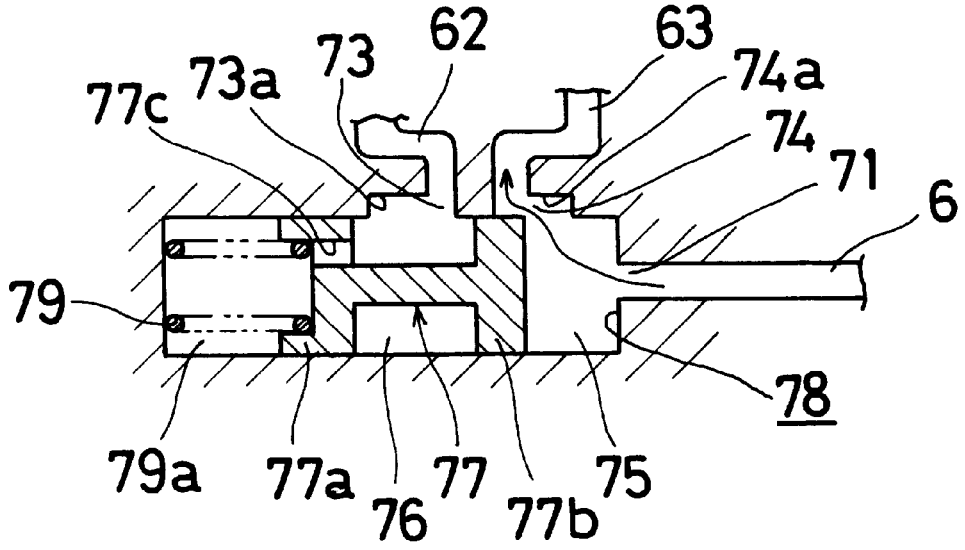
FIG. 3 is a sectional view of a control valve in accordance with the present invention, when the revolving speed of the rotor is from middle speed to high speed.

As a result, the control valve 7 is able to engage either a first condition where the second port 74 and the third port 73 communicate with each other so as to communicate the suction port 31*a* with the suction port 31*b* as shown in FIG. 1, a second condition where the first port 71 and the second port 74 communicate with each other via the head room 75 so as to communicate the branch passage 6 with the suction port 31*b* as shown in FIG. 3, and a third condition where the first port 71, the second port 74 and the third port 73 communicate with each other via the head room 75 so as to communicate the branch passage 6 with the suction port 31*a* and the suction port 31*b* as shown in FIG. 4. Since the axial length L1 of the first land portion 77*b* is smaller than the axial length L3 of the side passage 74, the control valve 7 is controlled to communicate between the third port 73 and the second port 74 via the intermediate room 76, and between the second port 74 and the first port 71 via the head room 75 in the transitional period from the first condition to the second condition.

In the above preferred embodiment, the volume of the spring room 79*a* is varied according to the movement of the valve member 77. However, the spring room 79 is always communicated with the third port 73 via the intermediate room 76 such that the pressure in the spring room 79 is the same as the pressure at the third port 73. Therefore, the valve member 77 is able to slide smoothly. In addition, since the axial length L1 of the first land portion 77*b* is smaller than the axial length L2 of the side passage 73, the third port 73 is not closed by the first land portion 77*b* on the transitional period from the second condition to the third condition. Thus, the spring room 79*a* is able to communicate with the third port 73 on the transitional period from the second condition to the third condition such that the valve member 77 is able to slide smoothly. Here, the spring room 79*a* is communicated with the suction port 31*a* such that there is no need to make an independent passage on the oil pump housing 1*a*. As a result, the oil pump apparatus of the preferred embodiment becomes smaller and it becomes possible to make the oil pump apparatus at relatively low cost.

An operation of the above preferred embodiment of the present oil pump apparatus will be hereinafter described.

When the revolving speed of the crankshaft of the internal combustion engine is low (the first condition), the pressure of the hydraulic-oil-delivery passage 5 and the branch passage 6 does not slide the valve member 77 against the spring 79 so that the suction port 31*a* and the suction port 31*b* communicate with each other. This means that the pockets 22*g* though 22*k* are able to suck the hydraulic oil, as shown in FIG. 1. Therefore, in the oil pump 1, the pockets 22*g* though 22*k* suck the hydraulic oil from the oil pan 69 via the suction ports 31*a* and 31*b*, and the pockets 22*b* though 22*e* discharge the hydraulic oil to the hydraulic-oil-delivery passage 5 via the discharge 77 port 33. The discharged hydraulic oil is delivered to the hydraulic oil receiving unit 80.

Figure 5:
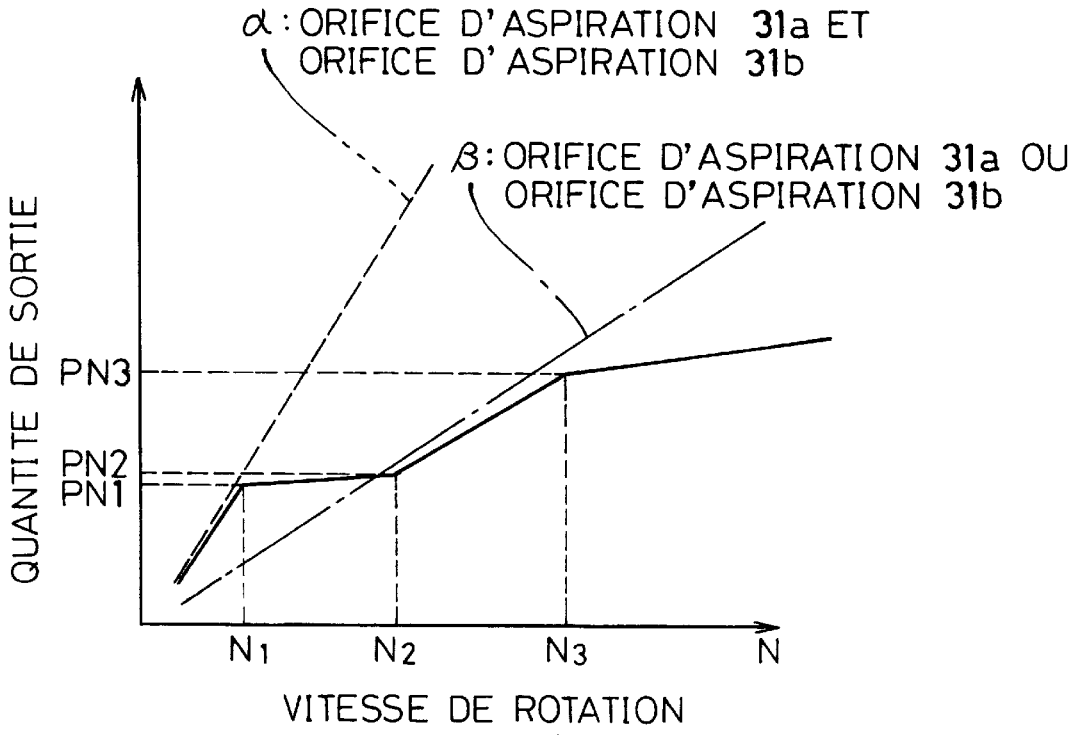
FIG. 5 is a graph illustrating an outlet-amount characteristic which is exhibited by the oil pump apparatus in accordance with the present invention.

In this case, the characteristic of the total outlet amounts, whose revolving speed is low (revolving speed N, 0<N<N), is obtained as shown in FIG. 5. FIG. 5 is a graph, which schematically illustrates the relationships between the revolving speeds of the internal combustion engine and the output amounts of the above preferred embodiment of the oil pump apparatus. The dotted line "__" of the drawing specifies that the characteristic of the total outlet amounts, which are sucked from both of the suction ports 31*a* and 31*b*. The alternate-long-and-short dash line "- - - " of the drawing specifies that the characteristic of the total outlet amounts, which are sucked from either the suction ports 31*a* or the suction port 31*b*. The characteristic of the total outlet amounts, whose revolving speed is low, is consistent with the dotted line "- - - ". Therefore, the required amount of the discharged hydraulic oil is obtained.

Figure 2:
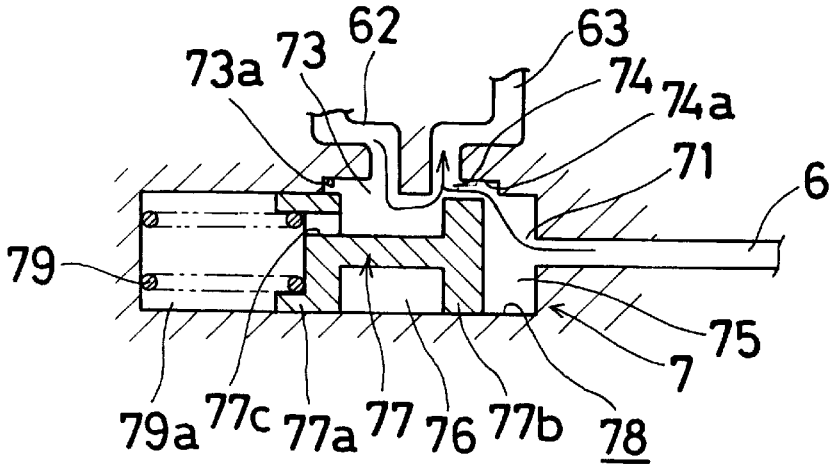
FIG. 2 is a sectional view of a control valve in accordance with the present invention, when the revolving speed of the rotor is from low speed to middle speed.

On the other hand, when the revolving speed of the internal combustion engine is from N1 to N2, for instance from 1,500 rpm to 2,500 rpm, the revolving speed of the inner rotor 2 is increased accordingly. Under these circumstances, the amount of the hydraulic oil discharged out of the discharge port 33 is increased, and thereby the hydraulic pressure is increased to more than a predetermined pressure (PN1) in the hydraulic-oil-delivery passage 5. Eventually, the actuating force in the head room 75 to the valve member 77 (the actuating force which occurs due to the pressure (PN1) in the hydraulic-oil-delivery passage 5), is increased to overcome the urging force of the spring 79, and accordingly, as can be understood from FIG. 2, the valve member 77 is slid in the leftward direction contracting the spring 79 elastically. Thus, when the valve member 77 of the control valve 7 is placed at the transition condition, the land portion 77*b* communicates the second port 74 with the intermediate room 76 and the head room 75. In this condition, the suction port 31*a* (the pockets 22*g* through 22*i*) sucks the hydraulic oil from the oil pan 69, and the suction port 31*b* (the pocket 22*k*) sucks the hydraulic oil from the suction port 31*a* via the second intermediate hydraulic passage 62, the third port 73, the intermediate room 76, a part of the second port 74 and the first intermediate hydraulic passage 63. At the same time, the suction port 31*b* sucks the hydraulic oil from the hydraulic-oil-delivery passage 5 via the branch passage 6, the first port 71, the head room 75, a part of the second port 74 and the first intermediate hydraulic passage 63. In this case, the characteristic of the total outlet amounts, whose revolving speed area is in the transition condition (N1<N<N2), is obtained as shown in FIG. 5. Here, when the valve member 77 is slid from the position described in FIG. 1 to that described in FIG. 2, the volume of the spring room 79*a* becomes accordingly small. The spring room 79*a* is communicated with the suction port 31 via the passage 77*c*, the intermediate room 76, the third port 73 and the second intermediate hydraulic passage 62 such that the valve member 77 is able to slide smoothly.

When the revolving speed of the internal combustion engine is 15 from N2 to N3, for instance, from 2,500 rpm to 4,000 rpm, the revolving speed of the inner rotor 2 is further increased accordingly. As can be understood from FIG. 3, the actuating force in the head room 75 to the valve member 77 (the actuating force which occurs due to the pressure (PN2) in the hydraulic-oil-delivery passage 5), is increased to overcome the urging force of the spring 79, and accordingly, the valve member 77 is slid in the leftward direction contracting the spring 79 elastically. Thus, the valve member 77 of the control valve 7 is placed at the second condition, whose revolving speed is at middle speed. In the second condition, the land portion 77*b* closes the communication between the second port 74 and the third port 73. The suction port 31*a* (the pockets 22*g* through 22*i*) sucks the hydraulic oil from the oil pan 69. At the same time, the suction port 31*b* (the pocket 22*k*) sucks the hydraulic oil from the hydraulic-oil-delivery passage 5 via the branch passage 6, the first port 71, the head room 75, the second port 74 and the first intermediate hydraulic passage 63. In this case, the characteristic of the total outlet amounts, whose revolving speed area is the second condition (N2<N<N3), is obtained as shown in FIG. 5. As also shown in FIG. 5, the characteristic of the total outlet amounts of the second condition is the difference of the characteristic of the suction port 31*b* subtracted from the characteristic of the total outlet amounts whose revolving speed area is low. Here, when the valve member 77 is slid from the position described in FIG. 2 to that described in FIG. 3, the volume of the spring room 79*a* becomes accordingly small. The spring room 79*a* is communicated with the suction port 31 via the passage 77*c*, the intermediate room 76, the third port 73 and the second intermediate hydraulic passage 62 such that the valve member 77 is able to slide smoothly.

Furthermore, when the revolving speed of the internal combustion engine is increased, for instance, to more than 4,000 rpm, the revolving speed of the inner rotor 2 is increased accordingly. As can be understood from FIG. 4, the actuating force in the head room 75 to the valve member 77 (the actuating force which occurs due to the pressure (PN3) in the hydraulic-oil-delivery passage 5) is increased to overcome the urging force of the spring 79, and accordingly, the valve member 77 is further slid in the leftward direction contracting the spring 79 elastically. Thus, the valve member 77 of the control valve 7 is placed at the third condition, whose revolving speed is high. In the third condition, the land portion 77*b* communicates the third port 73 with the head room 75. Therefore, both the suction ports 31*a* and 31*b* suck the hydraulic oil from the hydraulic-oil-delivery passage 5. The characteristic of the total outlet amounts, whose revolving speed area is the third condition (N3<N), is obtained as shown in FIG. 5. Here, when the valve member 77 is slid from the position described in FIG. 3 to that described in FIG. 4, the volume of the spring room 79*a* become accordingly small and the land portion 77*b* does not close the third port 73.

Therefore, the spring room 79*a* is communicated with the suction port 31*a* via the passage 77*c*, the intermediate room 76, the third port 73 and the second intermediate hydraulic passage 62 such that the valve member 77 is able to slide smoothly.

What is claimed is:

1. An oil pump apparatus comprising:

an oil pump housing;

a rotor rotatably located in the oil pump housing, the rotor forming a first set of pockets having a capacity increasing toward a rotating direction of the rotor and a second set of pockets having a capacity decreasing toward the rotating direction of the rotor;

a plurality of suction ports connected with the first set of pockets, each of the suction ports being isolated from other adjacent suction ports;

a discharge port connected with the second set of the pockets; and a control valve including a body to provide a chamber, a first port, a second port, a third port, a valve member slidably disposed in the chamber, an urging member for urging the valve member and an urging member's chamber for disposing the urging member, the first port communicating between the discharge port and the chamber, the second port communicating between one of the suction ports and the chamber, and the third port communicating between the other suction ports and the chamber;

a first land portion provided by the valve member for receiving the fluid pressure via the first port and controlling the opening and closing of the first port, the second port and the third port, wherein the axial length of the first land portion is smaller than that of an opening in the third port; and a second land portion provided on the valve member, which defines the urging member's chamber between the body and one side of said valve member, and having a passage which communicates between the urging member's chamber and at least one of said suction ports.

2. An oil pump apparatus according to claim 1, wherein the control valve is operatively positioned to control fluid flow through the plurality of the suction ports and the discharge port, and the control valve is operatively connected to select between a first condition in which the control valve connects with the suction ports and a second condition in which the control valve connects the discharge port with said one of the suction ports and cuts off the other suction ports wherein the urging member's chamber is always communicated with at least one of said suction ports.

3. An oil pump apparatus according to claim 1, wherein the chamber is provided with a first side passage which is formed in the opening of the second port and the axial length of the first land portion is smaller than that of the first side passage.

4. An oil pump apparatus according to claim 1, wherein the chamber is provided with a second side passage which is formed in the opening of the third port and the axial length of the first land portion is smaller than that of the second side passage.

5. An oil pump apparatus according to claim 4, wherein the chamber is provided with a second side passage which is formed in the opening of the third port and the axial length of the first land portion is smaller than that of the second side passage.

6. An oil pump apparatus according to claim 1, wherein the chamber is provided with a first side passage which is formed in the opening of the second port and the axial length of the first land portion is smaller than that of the first side passage so as not to close the opening of the third port by the first land portion.

* * * * *